United States Patent [19]

Puckett

[11] 4,119,049

[45] Oct. 10, 1978

[54] METHOD OF MAKING PATTERNED TUFTED FABRICS

[75] Inventor: Sandres Alfred Puckett, Laurinburg, N.C.

[73] Assignee: Fieldcrest Mills, Inc., Eden, N.C.

[21] Appl. No.: 554,178

[22] Filed: Feb. 28, 1975

Related U.S. Application Data

[62] Division of Ser. No. 257,152, May 26, 1972, Pat. No. 3,908,570.

[51] Int. Cl.[2] ..... D05C 3/00

[52] U.S. Cl. ..... 112/266

[58] Field of Search ..... 112/266, 410, 411, 79 R, 112/79 A, 79 FF, 262

[56] References Cited

U.S. PATENT DOCUMENTS

| | | | |
|---|---|---|---|
| 3,109,395 | 11/1963 | Batty et al. | 112/79 R |
| 3,396,687 | 8/1968 | Nowicki | 112/410 X |
| 3,585,948 | 6/1971 | Cobble | 112/79 R |
| 3,650,228 | 3/1972 | Lynch | 112/79 R |

*Primary Examiner*—H. Hampton Hunter

*Attorney, Agent, or Firm*—Bell, Seltzer, Park & Gibson

[57] ABSTRACT

A method of making tufted pile fabrics wherein first and second sets of pile yarns are shogged laterally to form respective rows of pile tufts on one surface of a base material, with the pile yarns of the respective sets crossing the rows of pile tufts formed of the pile yarns of the other sets on the reverse side of the base material from the pile tufts.

8 Claims, 10 Drawing Figures

P-2
P-1
P-2
P-1
P-2
P-1

METHOD OF MAKING PATTERNED TUFTED FABRICS

This application is a division of my copending application entitled PATTERNED TUFTED FABRICS AND METHOD OF MAKING SAME, Ser. No. 257,152, filed May 26, 1972 now U.S. Pat. No. 3,908,570.

Tufted fabrics of the type having variegated tuft patterns on one face thereof formed of pile yarns extending through a base material and also extending laterally on the reverse side of the base material between adjacent longitudinal rows of tufts, are well known in the art, as disclosed, for example, in U.S. Pat. Nos. 3,026,830; 3,109,395; 3,249,078 and 3,396,687. In some such fabrics two sets of pile yarns are used and, between the formation of successive tufts, the needle bars for either or both sets of pile yarns are shogged laterally a distance equal to the distance from one row of tufts to the next adjacent row so that tufts of both sets of pile yarns always appear at certain intervals in the same rows of tufts.

It is also known to utilize two lateral rows of tufting needles with the needles aligned with respect to the path of travel of a base material, and wherein the base material is shifted to and fro laterally of its path of travel at the point of action of one only of the rows of needles so that the pile yarns carried thereby extend in a zigzag manner across straight rows of tufts formed of the pile yarns carried by the other row of needles, as disclosed in U.S. Pat. No. 3,585,948, for example.

It has now been determined that enhanced pattern effects are obtainable by utilizing at least two lateral rows of tufting needles with the needles in one row staggered relative to the needles in the other row, but which rows of needles are shogged or shifted laterally a distance equal to twice the distance between the center of two adjacent rows of tufts to form respective separate rows of tufts from respective sets of pile yarns carried by the two rows of needles, with tufts of different yarns of the same set appearing at certain successive intervals in given rows of tufts, and wherein the pile yarns forming alternate rows of tufts cross the pile yarns forming intervening rows of tufts, and vice versa, on the reverse side of the base material from the pile tufts.

It is therefore an object of this invention to provide a method of making a patterned tufted fabric wherein a plurality of sets of pile yarns are shogged or shifted laterally of a base material to form respective longitudinal rows of pile tufts on one face of the base material, and wherein, between the formation of successive tufts, each pile yarn of at least one set extends laterally across one or more adjacent rows of tufts formed from pile yarns of a different set.

It is another object of this invention to provide a method of making a tufted pile fabric wherein pile yarns penetrate a base material and form on one surface thereof longitudinal rows of pile tufts, with each of the longitudinal rows of tufts comprising successive groups of pile tufts and with each group having a series of pile tufts therein. The pile tufts in any given group are formed of the same pile yarn with adjacent groups of pile tufts in each longitudinal row being formed of different pile yarns, alternate rows of pile tufts being formed of one set of pile yarns and intervening rows of pile tufts being formed of a different set of pile yarns, and wherein the pile yarns forming the alternate rows of pile tufts cross the pile yarns forming the intervening rows of pile tufts on the reverse side of the base material from the pile tufts.

According to the method, first and second parallel rows of spaced apart tufting needles are employed with respective first and second sets of pile yarns carried thereby, and wherein the first needles are staggered relative to the second needles. A base material is advanced longitudinally while the pile yarns carried by the needles are inserted through the base material to form respective rows of pile tufts of the first and second pile yarns while, at times, between the formation of successive tufts, both rows of needles are shifted laterally of the base material to lay the first pile yarns across the back of adjacent rows of tufts formed of the second pile yarns and to lay the second pile yarns across the back of adjacent rows of tufts formed of the first pile yarns whereby tufts of each first yarn are formed adjacent opposite sides of tufts of each second yarn, and vice versa, in at least a portion of the tufted pile fabric.

Some of the objects of the invention having been stated, other objects will appear as the description proceeds when taken in connection with the accompanying drawings in which FIGS. 1, 2 and 3 are fragmentary views of three partially tufted fabric sections formed in accordance with this invention and embodying respectively different variegated patterns, all of which may evolve from the same patterned manipulations of the pile yarns, but which are formed by utilizing respective differently arranged colors of pile yarns;

Figure 4:
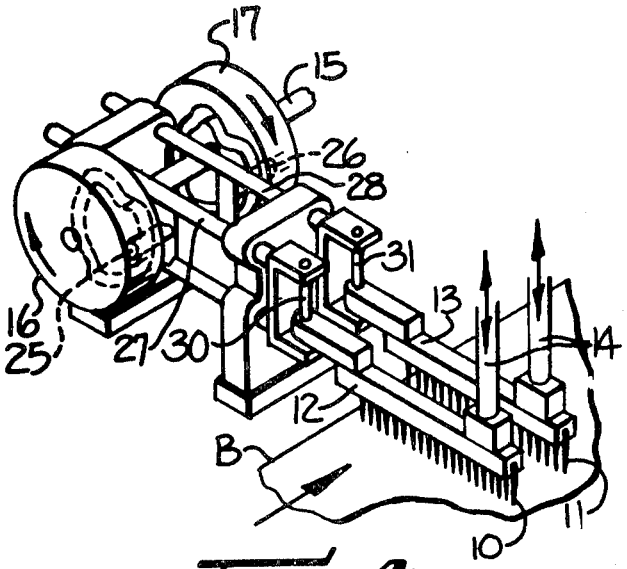
FIG. 4 is a fragmentary perspective view of a portion of a tufting machine showing how the needle bars and the respective rows of tufting needles may be manipulated in accordance with the method of this invention.
Figure 5:
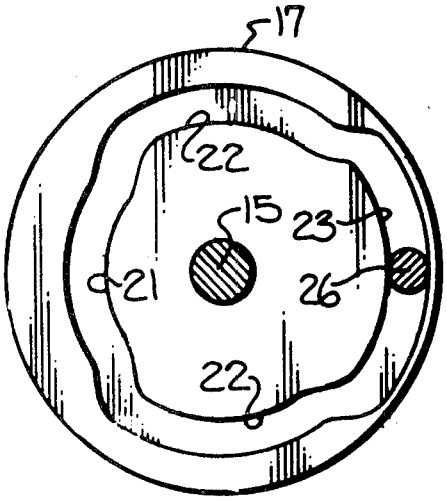
FIG. 5 is an enlarged elevation of one of the pattern control cams shown in FIG. 4 for effecting lateral shifting of the respective row of tufting needles.

Referring more specifically to the drawings, portions of a tufting machine suitable for forming the novel fabrics according to the method of this invention are shown in FIGS. 4 and 5. The tufting machine may be in the form of a suitable modified conventional tufting machine of the general type disclosed in U.S. Pat. No. 3,396,687, and having at least two rows of tufting needles, but wherein the pile yarns and the tufting needles are arranged and controlled in a manner peculiar to the present invention. Accordingly, only so much of the tufting machine will be described as is deemed necessary to a clear understanding of the method, of this invention, and reference is made to U.S. Pat. No. 3,396,687 for a more detailed description of a tufting machine.

As shown in FIG. 4, the tufting machine may include at least two parallel rows of spaced apart tufting needles, namely, a first row 10 and a second row 11. The rows of tufting needles 10, 11 may be carried by a common needle bar, but are shown carried by respective needle bars 12, 13 extending laterally over a forwardly and longitudinally advancing base material B through which first and second sets of pile yarns, carried by the respective needles 10, 11 are inserted. The tufting needles 10, 11 cooperate with respective loopers, now shown, to form pile tufts of the pile yarns inserted through the base material B as is conventional. Accordingly, details of the supporting means for the base material B and the loopers are not shown and will not be described in detail.

The needle bars 12, 13 are carried by vertically reciprocating rods 14 driven to reciprocate in timed relation to a rotating cam shaft 15. Cam shaft 15 has a pair of control cams 16, 17 mounted thereon which serve as pattern means for shogging or shifting the respective needle bars 12, 13 and needles 10, 11 laterally of the path of travel of base material B at predetermined intervals and for predetermined distances, according to a predetermined pattern. It is apparent that needles 10, 11 occupy a raised or withdrawn position with respect to base material B whenever the needles are shifted laterally of base material B.

Figure 3:
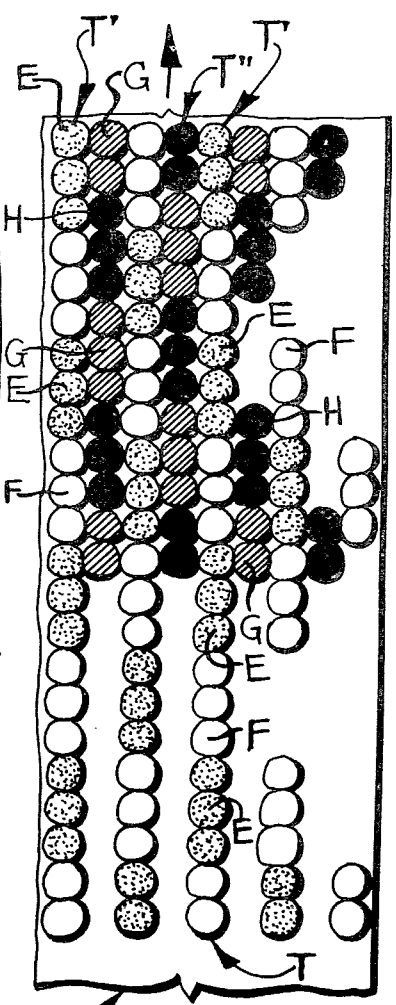
FIGS. 1A, 2A and 3A are fragmentary views looking at the reverse side or back side surfaces of the respective tufted fabric sections shown in FIGS. 1, 2 and 3, and also showing an arrangement of two needle bars which are out-of-phase with respect to the cyclical pattern of the respective sets of pile yarns.
Figure 1:
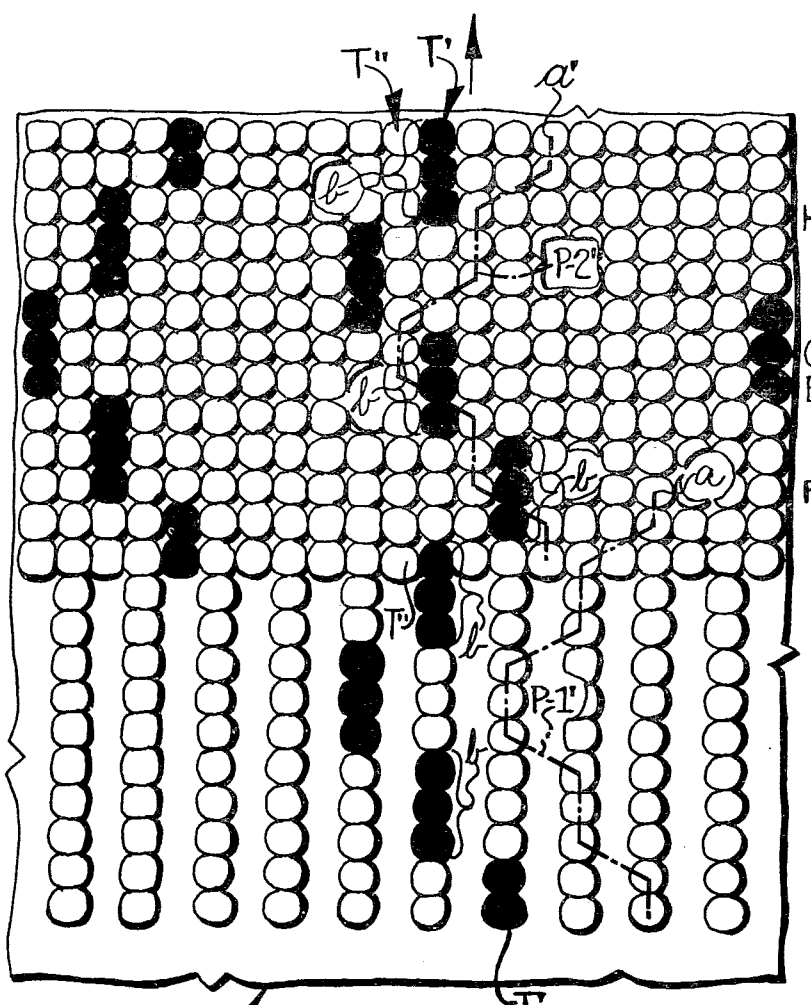
Figure 2:
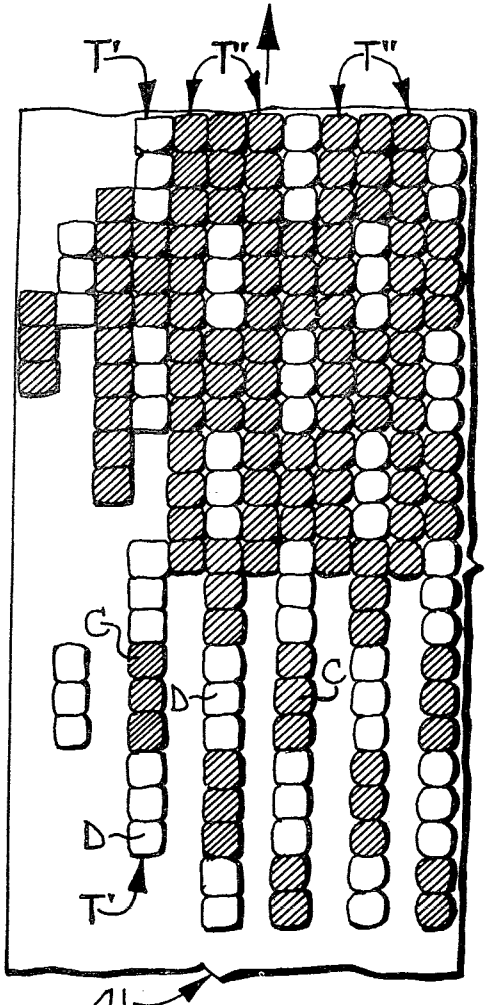
Figure 3:
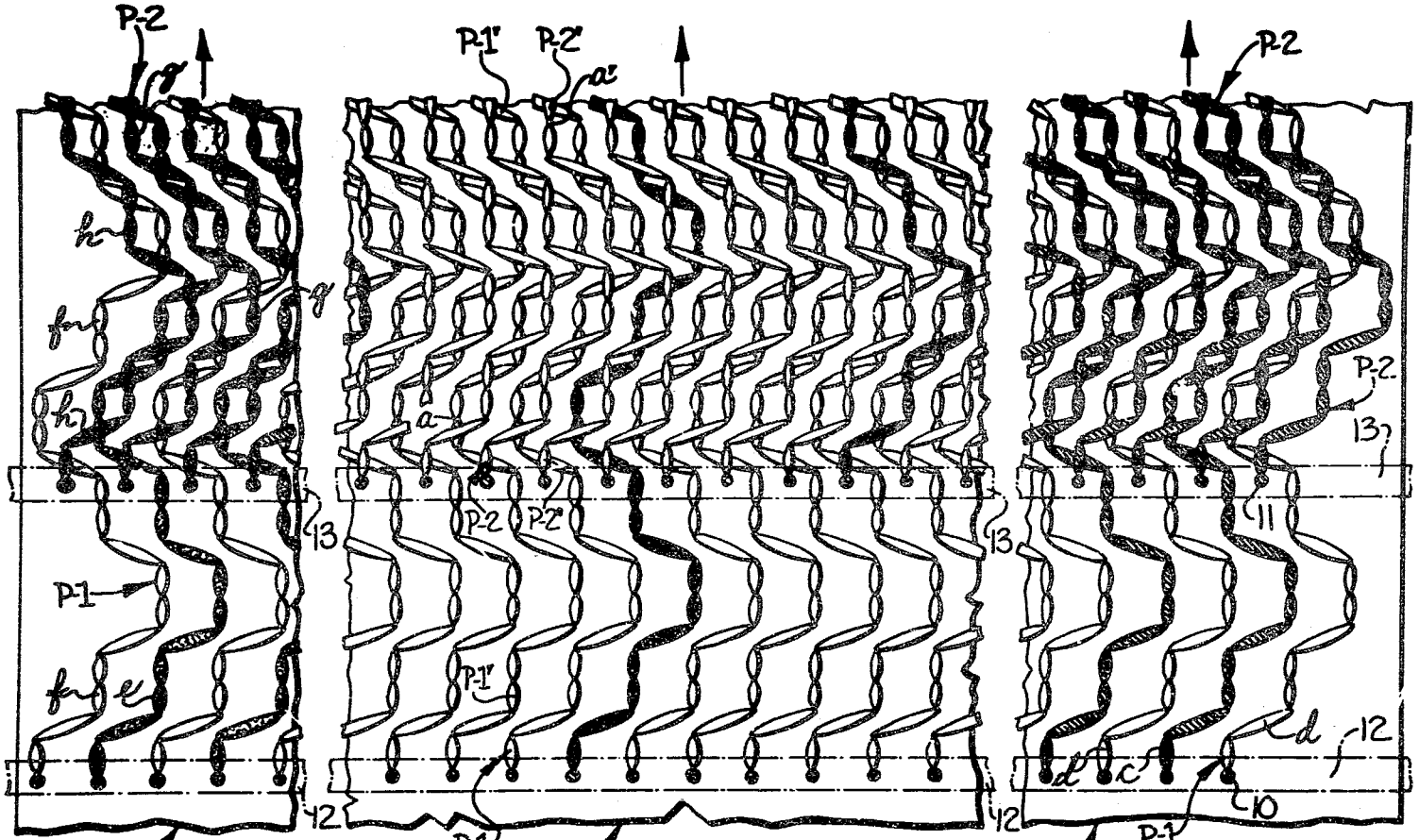

In this instance, control cams 16, 17 are shown as being configured for forming the fabric sections of FIGS. 1–3 such as to cause each needle bar 12, 13 to occupy three different positions at different times laterally of the path of travel of base material B. Thus, each cam 16, 17 is in form of a grooved disc or face cam having low, high and intermediate cam surfaces 21–23 spaced at different radii from the axis of cam shaft 15. The grooves in the respective control cams 16, 17 are engaged by followers 25, 26 carried by respective guide bars 27, 28. Guide bars 27, 28 are suitably guided for lateral movement in the frame of the machine and have respective posts 30, 31 mounted on their inner ends on which the adjacent ends of needle bars 12, 13 are guided for vertical movement.

Referring to FIGS. 1A–3A, it will be observed that needle bars 12, 13 are shown in phantom lines superimposed over the back side of fabric sections broadly designated at 40, 41, 42, all of which may be combined in a single tufted fabric if desired. According to the invention, in the fabric embodiments of FIGS. 1–3 and the respective FIGS. 1A–3A, the longitudinal rows of pile tufts are formed from at least two sets of pile yarns, with alternate longitudinal rows of tufts being formed of one set of pile yarns and with intervening longitudinal rows of pile tufts being formed of another set of pile yarns. Thus, as shown in FIGS. 1A–3A, the first needles 10 are staggered relative to the second needles 11, and respective first and second sets of pile yarns P-1, P-2 are threaded through or carried by the respective first and second rows of tufting needles 10, 11.

Since the alternate rows of pile tufts are formed of the first set of pile yarns P-1 and intervening rows of pile tufts are formed of the second set of pile yarns P-2, it follows that the lateral distance between the centers of adjacent tufting needles in each row is twice the gauge of the fabric. The term "gauge" as used herein means the distance between the centers of two immediately adjacent rows of tufts. Thus, the staggered relationship between the first and second needles 10, 11 is such that there is a distance of one gauge between the center of each first needle 10 and the next adjacent second needle 11 measured laterally of the path of travel of the base material B. However, there is a distance of two gauges between the adjacent needles in each row 10, 11. Also, the difference between the radii of adjacent cam surfaces 21–23 (FIG. 5) preferably is such as to effect movement to the needle bars 12, 13 of two gauges, although such movement may be a multiple of two gauges, if desired.

For illustrative purposes, control cams 16, 17 are shown in FIG. 4 as being positioned in in-phase relationship so that, during each lateral shifting movement of the needle bars 12, 13 and tufting needles 10, 11 all of the needles 10, 11 move the same distance (Two gauges) and in the same direction. Accordingly, the first row of tufting needles 10 is spaced rearwardly of the second row of tufting needles 11 in out-of-phase relation thereto with respect to the particular pattern cycle of the needles 10, 11. By way of example, twelve successive tufts are formed of each pile yarn P-1, P-2 during the formation of each cyclical pattern repeat of the pile yarns in forming the rows of pile tufts, but the path traced by each first pile yarn P-1 is shown to be 60° out-of-phase with the path traced by each second pile yarn P-2 in each pattern repeat. In other words, the distance between the starting point of each repeat cycle of the first set of pile yarns P-1 and that of the second set of pile yarns P-2 is shown as being equivalent to twice the space between two adjacent tufts in any given longitudinal row.

For purposes of clarity, the first and second rows of needles 10, 11 are shown in FIGS. 1A–3A with their centers spaced apart longitudinally of the direction of travel of the base material B a distance equivalent to the amount of longitudinal movement imparted to the base material B incident to the formation of 10 successive pile tufts by each needle 10, 11. That is, the needle rows 10, 11 are shown 300° out-of-phase in FIGS. 1A–3A. It is preferred, however, that the first row of needles 10 is positioned the equivalent of two tufts forwardly or rearwardly of the second row of tufting needles 11 so that the needle rows are 60° out-of-phase with respect to the tuft pattern being formed. Also, in forming the fabric sections 40, 41, 42 tufting needles 10, 11 may be mounted on a common needle bar controlled by a single control cam, if desired.

Referring now to FIGS. 1–3, it will be observed that each fabric section 40–42 includes alternate rows of pile tufts T′ with intervening rows of pile tufts T″ between the alternate rows. The alternate and intervening tuft rows T′, T″ are formed of the respective first and second sets of pile yarns P-1, P-2. However, each row of tufts is formed of several different pile yarns of the same respective set because, at predetermined intervals, and between the formation of successive tufts, each pile yarn in each set P-1, P-2 (FIGS. 1, 2 and 3) is shogged or shifted laterally two gauges in one direction or in the opposite direction so that the pile yarns of one set extend across the back of the rows of tufts formed of the pile yarns of the other set, and vice versa. It should be noted that none of the tufts in the alternate rows of tufts T′ are formed of the pile yarns in the second set P-2 and none of the tufts in the intervening rows of tufts T″ are formed of the pile yarns in the first set P-1.

As the base material B advances toward the top of the drawing in FIGS. 1A, 2A and 3A, each pile yarn is caused to trace a predetermined irregular path of the same shape over the back side of the base material, although the path of each pile yarn of the first set P-1 is out-of-phase with respect to the path of each pile yarn of the second set P-2. Therefore, for purposes of clarity, only the paths traced by one pile yarn in each set will be described with reference to FIGS. 1 and 1A, such pile yarn of the first set P-1 being identified as P-1' and such pile yarn of the second set P-2 being identified as P-2'.

At the start of a repeat cycle, it may be assumed that one of the needles 10 has inserted pile yarn P-1' through the base material B at point *a* in FIG. 1A and, at the same time, one of the needles 11 has inserted the pile yarn P-2' through the base material B at point *a'* which is 300° of a pattern repeat or cycle ahead of the point *a*. Thus, all of the pile yarns in the first set 10 will have previously been formed into the alternate rows of tufts T' (FIGS. 1, 2 and ) in that portion of each fabric section 40, 41, 42 located forwardly of the point *a* in FIGS. 1 and 1A.

During formation of the tufts at points *a, a'* as well as the next succeeding tufts, the low surfaces 21 (FIG. 5) of the respective cams 16, 17 are in engagement with followers 25, 26. Thereupon, the corresponding intermediate surfaces 22 of cams 16, 17 move into engagement with followers 25, 26 and thus shift both needle bars 12, 13 to the right in FIGS. 1A, 2A and 3A (to the left in FIGS. 1–3) for two gauges so that all of the pile yarns in the second set are caused to extend across the adjacent pile yarns P-1 which had previously formed the alternate rows of pile tufts T' forwardly of the rearward or first needle bar 12.

Each of the needles 10, 11 in each set then forms a group of tufts comprising a series of three successive pile tufts of the same respective pile yarn, during which the followers 25, 26 dwell in engagement with cam surfaces 22. The succeeding high surfaces 23 of cams 16, 17 then move into engagement with followers 25, 26 to again shift both needle bars 12, 13 two gauges to the right in FIGS. 1A–3A, whereupon a series of three additional successive pile tufts are formed in the base material from each respective pile yarn by each of the tufting needles 10, 11, and during which the high surfaces 23 of the cams 16, 17 remain in engagement with the respective followers 25, 26. Thereupon, the next succeeding intermediate surfaces 22 of cams 16, 17 move into engagement with the respective followers 25, 26 to shift needle bars 12, 13 two gauges to the left in FIGS. 1A–3A, and three more pile tufts then are formed of each respective pile yarn P-1, P-2.

The low surfaces 21 of cams 16, 17 then again move into engagement with followers 25, 26 to again shog or shift both needle bars 12, 13 two gauges to the left and to their original positions. Thereafter, an additional tuft is formed of each of the pile yarns P-1, P-2 to complete a cycle in the patterned manipulation of the pile yarns. It should be noted that, each time that needle bars 12, 13 are shifted laterally for two gauges, in the manner heretofore described, the second row of needles 10 lays the second pile yarns P-2 across the adjacent, alternate rows of tufts T' of the first pile yarns P-1, and this also causes the pile yarns of the first set P-1 to cross the intervening rows T'' formed of the pile yarns of the second set P-2. In so doing, tufts of each first pile yarn are caused to be positioned adjacent opposite sides of tufts formed of each second pile yarn P-2 and vice versa.

Additionally, since needle bars 12, 13 dwell in predetermined positions during a formation of longitudinal series of three tufts by each tufting needle 10, 11 and following each time that needle bars 12, 13 are shifted laterally for two gauges, each longitudinal row of pile tufts comprises successive groups of the pile tufts each having a series of three pile tufts therein. Also, the pile tufts in any given group are formed of the same pile yarn, but adjacent groups of pile tufts in each longitudinal row are formed of different pile yarns.

This may be more clearly understood with reference to the upper portion of FIG. 1 wherein it is shown, for example, that there are longitudinally spaced groups *b* of shaded or colored tufts in each of three adjacent alternate rows T' on the central portion of fabric section 40, but adjacent groups of the shaded tufts *b* in the same longitudinal row are separated by groups of at least three white or uncolored tufts which are formed from different pile yarns from that of which the groups of shaded tufts *b* are formed in the same alternate rows T'. All of the tufts in any given group *b* are formed of the same pile yarn and, as a matter of fact, all of the particular groups of tuft *b* in the central portion of FIG. 1 are formed of the same pile yarn in this instance.

Because of the fact that the needles 10, 11 are staggered and the tufts formed of any given pile yarn are formed in succession as the base material B is advanced past the rows of tufting needles 10, 11, it will be observed in the upper central portion of FIG. 1 that the successive groups of shaded pile tufts *b* in a given one of the alternate rows T' are offset with respect to the groups of shaded pile tufts *b* in other adjacent alternate rows T'. Also, it is apparent that in the upper central portion of FIG. 1A that the offset pile tufts in adjacent alternate rows are interconnected by the respective pile yarn extending across the back of the intervening rows T' along the back of the base material B. It follows from the foregoing description that offset pile tufts in adjacent intervening rows T'' also are interconnected by the respective pile yarn extending across the back of the alternate rows T' along the back of the base material.

As heretofore indicated, fabric sections 41, 42 are formed in the same manner as, and may even be formed integral with fabric section 40. The fabric sections 41, 42 differ from fabric section 40 simply by the choice of pile yarns. For illustrative purposes, it will be observed in FIG. 1A that the majority of the pile yarns are white, with only one of the pile yarns P-1 which forms one of the aforementioned alternate rows of pile tufts T' being a shaded or black yarn along the approximate central portion of fabric section 40. Also, only two of the pile yarns P-2 of the second set, and which form portions of corresponding intervening rows of pile tufts T'' are shaded or black pile yarns spaced substantial distances to either side of the aforementioned shaded or black pile yarn in the first set P-1.

Although fabric section 41 is formed in the same manner as fabric section 40, it will be observed in FIG. 2A that alternate pile yarns *c* of the first set P-1 are colored yarns; e.g., green, and intervening pile yarns *d* of the first set P-1 are white. Also, all of the pile yarns of the second set P-2 are of the same color as the alternate pile yarns *c* of the first set P-1. Thus, it will be observed in FIG. 2 that, on the pile face of fabric section 41, alternate rows of tufts T' each have longitudinally spaced groups of three colored tufts C therein with groups of three white tufts D disposed therebetween and formed of the respective pile yarns *c, d* (FIG. 2A) of the first set P-1. Also, the colored tuft groups C are offset in adjacent alternate rows T'. On the other hand, all of the tufts are of the same color throughout the length of each intervening row of tufts T'', since all of the pile yarns P-2 in FIG. 2A are of the same color.

Although the fabric section 42 in FIGS. 3 and 3A also is formed in the same manner as fabric sections 40, 41, the pile face of fabric section 42 (FIG. 3) has a substantially different aesthetic appearance than the pile faces of fabric sections 40, 41 (FIGS. 1 and 2), because of a different arrangement of colored pile yarns. Accordingly, it will be observed in FIG. 3A that alternate pile yarns *e* of the first set P-1 may be gray yarns, for example, and intervening pile yarns *f* of the first set P-1 are white yarns.

Additionally, alternate pile yarns *g* in the second set P-2 are green yarns, for example, and intervening pile yarns *h* in the second set P-2 are black yarns, for example. Thus, it will be observed in FIG. 3, that on the pile face of fabric section 42, alternate rows of tufts T′ each have longitudinally spaced groups of three gray tufts E therein with groups of three white tufts F therebetween formed of the respective pile yarns *e, f* (FIG. 3A) of the first set P-1, and wherein the groups of gray tufts E are offset in adjacent alternate rows T′.

Also, it will be observed in FIG. 3 that intervening rows of tufts T″ each have longitudinally spaced groups of green tufts G therein with groups of three black tufts H therebetween formed of the respective pile yarns *g, h* (FIG. 3A) of the second set P-2, and wherein the groups of green tufts G are offset in adjacent intervening rows T″. It will be noted in FIG. 3 that adjacent groups of gray and white tufts E, F in alternate rows T′ are partically offset with respect to adjacent groups of green and black tufts G, H in the intervening rows T″. Thus, although a pattern of pile tufts is presented, the different colors of tufts are somewhat randomly disposed throughout the pattern.

As heretofore described, the needle bars 12, 13 are positioned out-of-phase with respect to the pattern of tufts being formed and are shifted laterally in a unitary manner to produce fabric sections 40, 41, 42 as shown in FIGS. 1, 2 and 3. Thus, in forming fabric sections 40, 41, 42, a single cam may be utilized, instead of the two cams 16, 17 of FIGS. 4 and 5, for shifting the needle bars 12, 13 laterally of the path of travel of the base material B, if desired. However, the two cams 16, 17 are provided in FIG. 4 to facilitate lateral shifting of needle bars 12, 13 independently of each other, as may be desirable in forming some tuft patterns. Also, by changing the relative angular positions of control cams so that they are 60° out-of-phase, for example, needle bars 12, 13 may be located in in-phase relationship for producing the fabric sections 40, 41, 42, if desired.

Figure 7:
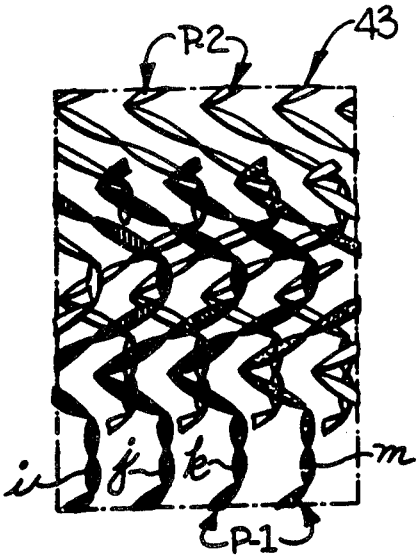
FIG. 7 is a view of the reverse side surface of the fabric section shown in FIG. 6.
Figure 6:
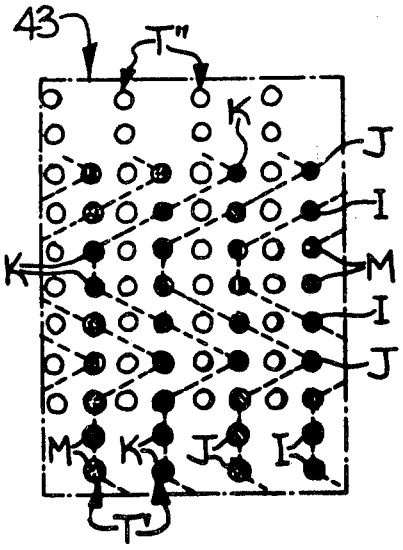
FIG. 6 is a schematic view of the pile face of another fabric section illustrating a single repeat in the patterning of each of the two sets of pile yarns, which repeat differs from the repeats of FIGS. 1–3 and 1A–3A.

Referring now to FIGS. 6 and 7, there is shown a single pattern repeat in a fabric section 43 which may be formed by arranging the needle rows 10, 11 in out-of-phase relation substantially as described with respect to fabric sections 40–42, but wherein the needle rows 10, 11 would be 80° out-of-phase and the sequence of the lateral stepwise movements of the needle bars 12, 13 is different from that described with respect to the forming of fabric sections 40–42. Of course, the configuration of the grooves in cams 16, 17 would be different from that shown in FIG. 5 for forming the fabric section 43.

As is the case with respect to FIGS. 1A, 2A, 3A, the first and second sets of pile yarns shown in FIG. 7 are broadly designated at P-1 and P-2, respectively. The first pile yarn set P-1 in FIG. 7 may include a lateral series of red, green black and gray pile yarns *i, j, k, m* in each lateral repeat and all of the pile yarns of the second set P-2 may be white yarns. Reading upwardly from the bottom of FIG. 7, it can be seen that a group of three successive tufts is formed from each pile yarn in each set P-1, P-2, whereupon the needle bars are shifted laterally two gauges to the left. A single tuft then is formed from each pile yarn, and the needle bars then shift two gauges to the right and another tuft is formed from each pile yarn. Thereafter, the needle bars are again shifted two gauges to the right, whereupon two successive tufts are formed of each pile yarn longitudinally of the fabric. The needle bars 12, 13 then move to the left for two successive steps of two gauges each with a tuft being formed from each pile yarn at the end of each step. Thereafter, needle bars 12, 13 are again shogged two gauges to the right to complete the pattern cycle.

Thus, it will be observed in FIG. 6 that, on the pile face of fabric section 43, each of the alternate rows T′ includes pile tufts of three different colors formed of the pile yarns in set P-1, and all of the tufts in each intervening row T″ are white tufts formed from the second set of pile yarns P-2. The tufts corresponding to the respective pile yarns *i, j, k, m* of the first set P-1 in FIG. 7, are indicated respectively at I, J, K and M in FIG. 6.

Because of the paths taken by each pile yarn in the pile yarn set P-1 in FIG. 7, and as indicated in broken lines in FIG. 6, the various colors of tufts are arranged in different sequences in the alternate rows of tufts T′ in the pattern repeat shown in FIG. 6. More specifically, the right-hand row T′ includes three tufts I, one tuft J, one tuft I, two tufts M, one tuft I and one tuft J in that order. The second alternate row T′ from the right in FIG. 6 includes three tufts J, one tuft K, one tuft J, two tufts I, one tuft J, and one tuft K in that order. The third alternate row T′ from the right in FIG. 6 includes three tufts K, one tuft M, one tuft K, two tufts J, one tuft K and one tuft M, in that order. The last or fourth alternate row of tufts T′ from the right in FIG. 6 includes three tufts M, one tuft I, one tuft M, two tufts K, one tuft M and one tuft I in that order.

The term "tufts," is used herein generically to mean loop pile tufts or cut pile tufts as the case may be, it being understood that, if desired, the tufting machine may be equipped with conventional cutting blades associated with the loopers thereof for cutting the pile loops on the machine, or the pile surfaces may be sheared after the fabric is removed from the tufting machine.

It is apparent from the foregoing disclosure that a wide variety of patterns of pile tufts of different colors or kinds may be obtained in tufted fabrics in accordance with this invention and, therefore, further illustrative examples of the fabrics of this invention is deemed unnecessary.

In the drawings and specification, there has been set forth a preferred embodiment of the invention and, although specific terms are employed, they are used in a generic and descriptive sense only.

What is claimed is:

1. A method of making a patterned tufted pile fabric utilizing first and second parallel rows of spaced apart tufting needles with respective first and second sets of pile yarns carried by the first and second rows of needles and wherein the needles of the first row are staggered relative to the needles of the second row; said method comprising advancing a base material longitudinally past the rows of tufting needles, and forming respective rows of pile tufts of the first and second sets of pile yarns on the advancing base material by (a) forming a longitudinal series of successive tufts from each of the respective first and second sets of pile yarns by inserting the first and second rows of needles through the base at longitudinally successive points, then (b) shifting both rows of needles laterally of the base material to lay the first and second sets of pile yarns across the back of adjacent rows of tufts formed of the respective second and first sets of pile yarns, and then (c) repeating the steps as prescribed whereby pile tufts of each pile yarn of the first set are formed adjacent opposite sides of pile tufts of each pile yarn of the second set and vice versa in at least a portion of the fabric.

2. A method according to claim 1, in which the steps of laterally shifting the rows of needles and inserting the needles through the base material are effected in predetermined sequence according to a predetermined pattern and further include maintaining one row of needles a predetermined out-of-phase distance ahead of the other row of needles with respect to each repeat of the pattern, and wherein the steps of laterally shifting the rows of needles also comprises shifting both rows of needles simultaneously in the same direction.

3. A method of making a patterned tufted pile fabric utilizing first and second parallel rows of spaced apart tufting needles with respective first and second sets of pile yarns carried by the first and second rows of needles and wherein the needles of the first row are staggered relative to the needles of the second row; said method comprising advancing a base material longitudinally while inserting the pile yarns carried by the rows of needles through the base material to form respective rows of pile tufts of the first and second sets of pile yarns and while, at times, between the formation of certain successive tufts, shifting both rows of needles laterally of the base material to lay the first set of pile yarns across the back of adjacent rows of tufts of the second set of yarns and to lay the second set of pile yarns across the back of adjacent rows of tufts of the first set of yarns whereby tufts of the first yarn set are formed adjacent opposite sides of tufts of the second yarn set, and vice versa, in at least a portion of the fabric.

4. A method according to claim 3, wherein the step of laterally shifting the rows of needles between the formation of certain successive tufts includes shifting all of the needles in the same lateral direction at any given time.

5. A method according to claim 3, where each lateral shifting of the rows of needles includes shifting all of the needles a distance equal to twice the spacing between the centers of two adjacent longitudinal rows of tufts.

6. A method according to claim 3, wherein the step of at times laterally shifting the rows of needles includes shifting all of the needles in one lateral direction for a distance equal to twice the spacing between the centers of two adjacent longitudinal rows of tufts at certain of said times, and shifting all of the needles in a lateral direction opposite from said one lateral direction for said distance at certain other of said times.

7. A method according to claim 3, wherein the step of at times shifting both rows of needles laterally of the base material comprises shifting both rows of needles laterally in one direction at certain of said times, again shifting both rows of needles in said one lateral direction at times following said certain of said times, then at certain other of said times, shifting both rows of needles in a lateral direction opposite from said one lateral direction, and again shifting both rows of the needles in said opposite direction at times following said certain other of said times.

8. A method of making a patterned tufted pile fabric utilizing first and second parallel rows of spaced apart tufting needles with respective first and second sets of pile yarns carried by the first and second rows of needles and wherein the needles of the first row are staggered relative to the needles of the second row; said method comprising advancing a base material longitudinally past the rows of tufting needles, and forming respective rows of pile tufts of the first and second sets of pile yarns on the advancing base material by (a) forming a first longitudinal series of successive tufts of each of the pile yarns by inserting the respective first and second rows of needles and the first and second sets of pile yarns through the base at longitudinally successive points, then (b) shifting both rows of needles in one direction laterally of the base material for a distance equal to twice the spacing between the centers of adjacent longitudinal rows of tufts, then (c) forming a second longitudinal series of successive tufts of each of the pile yarns by inserting the first and second rows of needles and the respective first and second sets of pile yarns through the base material at longitudinally successive points, then (d) again shifting both rows of needles in said one lateral direction for said distance, then (e) forming a third longitudinal series of successive tufts of each of the pile yarns by inserting the first and second rows of needles and the respective first and second sets of pile yarns through the base material at longitudinally successive points, and (f) repeating each of the steps (b), (c) and (d) in succession but during which the rows of needles are shifted in a direction opposite from said one lateral direction during each respective lateral shifting thereof, and then (g) repeating the steps as prescribed to form at least a portion of the fabric.

* * * * *